US007892035B2

(12) United States Patent
Tsai et al.

(10) Patent No.: US 7,892,035 B2
(45) Date of Patent: Feb. 22, 2011

(54) ELECTRICAL CARD CONNECTOR WITH MOVEABLE HOUSING

(75) Inventors: Tzu-Ching Tsai, Tu-Cheng (TW); Kuo-Chun Hsu, Tu-Cheng (TW)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/542,714

(22) Filed: Aug. 18, 2009

(65) Prior Publication Data

US 2010/0041276 A1 Feb. 18, 2010

(30) Foreign Application Priority Data

Aug. 18, 2008 (TW) ..... 97131450 A

(51) Int. Cl.
*H01R 24/00* (2006.01)

(52) U.S. Cl. ..... 439/634; 439/946

(58) Field of Classification Search ..... 439/630, 439/631, 632, 634, 635, 946
See application file for complete search history.

(56) References Cited

U.S. PATENT DOCUMENTS 6,887,087 B2 * 5/2005 Lai et al. ..... 439/138
7,059,910 B1 * 6/2006 Chang ..... 439/630
7,232,343 B1 6/2007 Iai
7,422,485 B2 * 9/2008 Yu et al. ..... 439/630
7,628,624 B2 * 12/2009 Ye et al. ..... 439/137
2010/0041276 A1 * 2/2010 Tsai et al. ..... 439/629

* cited by examiner

*Primary Examiner*—James Harvey
(74) *Attorney, Agent, or Firm*—Andrew C. Cheng; Wei Te Chung; Ming Chieh Chang

(57) ABSTRACT

An electrical card connector includes a first insulative housing (1), a number of first contacts (2) mounted in the first housing and having a first soldering portion (22), a second insulative housing (4) located behind the first housing, a number of second contacts (5) mounted in the second housing and having a second soldering portion (51), and a shell (6) covering the first housing and the second housing. The first housing and the second housing is separated each other. A gap (9) is formed between the shell and the second housing. The second housing with the second contacts moves around the gap, corresponding to the first housing, and then the second soldering portion is adjusted, the first soldering portion and the second soldering portion are in coplanar, and soldered on the PCB without missing.

10 Claims, 6 Drawing Sheets

ELECTRICAL CARD CONNECTOR WITH MOVEABLE HOUSING

BACKGROUND OF THE INVENTION

1. Field of the Invention

The present invention relates generally to an electrical card connector, and particularly to an electrical card connector with a movable housing for receiving at least two cards.

2. Description of Related Patent

A conventional electrical card connector, as disclosed in U.S. Pat. No. 7,232,343 which is issued on Jun. 19, 2007, is provided to receive different cards. The electrical card connector includes an insulative housing, three groups of contacts mounted in the housing and a shell covering the housing. Each terminal has a soldering portion soldered to a printed circuit board (PCB). The contact groups are located at the front portion, middle portion and the rear portion of the housing, respectively, and it is difficult to keep the three lows of the soldering portions in common plane. In case the soldering portions are no arranged coplanarly, i.e. some of the solder portions may not in contact with the printed circuit board. As a result, a so-called cold-joint will be encountered, and therefore rework is needed.

Hence, it is desirable to have an improved electrical card connector to overcome the above-mentioned disadvantages.

BRIEF SUMMARY OF THE INVENTION

Accordingly, the object of the present invention is to provide an electrical card connector with a movable insulative housing to adjust the position of the contacts mounted therein, in such a way that solder portions thereof are substantially adjusted to be disposed on a common plane to ensure reliable solder joints.

In order to achieve the above-mentioned object, an electrical card connector includes a first insulative housing, a plurality of first contacts mounted in the first housing and having a first soldering portion, a second insulative housing located behind the first insulative housing, a plurality of second contacts mounted in the second housing and having a second soldering portion, and a shell covering the first insulative housing and the second insulative housing. The first housing and the second housing is separated from each other. A gap is formed between the shell and the second housing. The second housing with the second contacts is movable within the shell, and the first soldering portion and the second soldering portion are coplanar.

Other objects, advantages and novel features of the invention will become more apparent from the following detailed description of the present embodiment when taken in conjunction with the accompanying drawings.

DETAILED DESCRIPTION OF THE INVENTION

Figure 1:
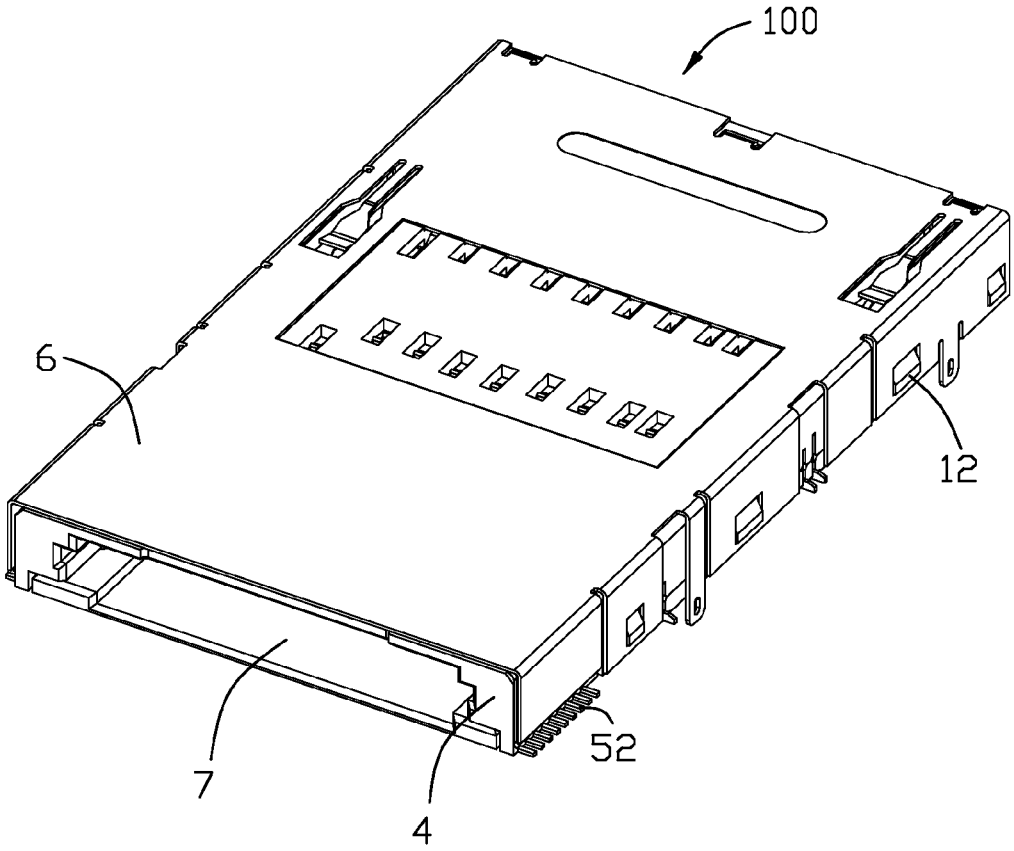
FIG. 1 is a perspective view of an electrical card connector in accordance with the present invention.
Figure 2:
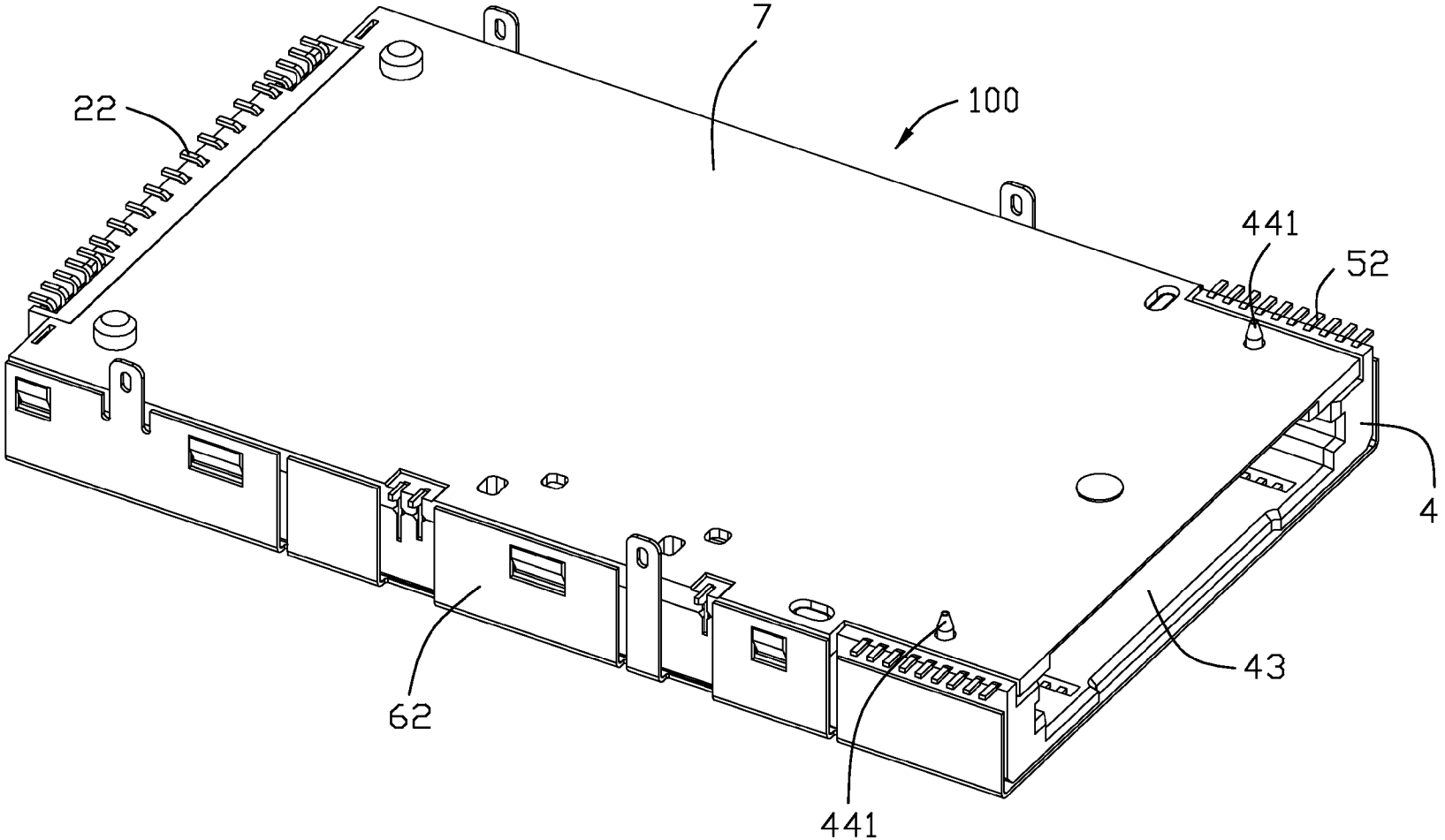
FIG. 2 is a perspective view of the electrical card connector shown in FIG. 1, but taken from other aspect.

Reference will now be made to the drawing figures to describe the present invention in detail.

Referring to FIG. 1 to FIG. 6, an electrical card connector 100 in accordance with the present invention is soldered on a printed circuit board(PCB) (not shown), and it comprises a first insulative housing 1, a plurality of first contacts 2 mounted in the first housing 1, a terminal module 3 assembled on the first housing 1, a second insulative housing 4 located behind the first housing 1, a plurality of second contacts 5 mounted in the second housing 4, a shell 6 covering the first housing 1 and the second housing 4, and a bottom plate 7.

The first housing 1 comprises a main portion 11, a pair of side walls 12 extending downwardly from the opposite sides of the main portion 11 and a receiving space 16 defined by the main portion 11 and the side walls 12. The top surface of the main portion 11 forms a receiving portion 14 and a plurality of through holes 15 communicating with the receiving space 16. The bottom edge of the side wall 12 has a plurality of retaining holes 13. A slider 17 is disposed in the receiving space 16 and assembled on the first housing 1, which comprises a plurality of slots 172 corresponding to the through holes 15. An inclined portion 173 is located at the front of each slot 172. A first ejector 171 and a second ejector 18 are assembled on the first housing 1, the first ejector 171 is used for ejecting a wider electrical card, such as SD card, from the receiving space 16, and the second ejector 18 is used for a narrower electrical card, such as MS card, from the receiving space 16.

Figure 3:
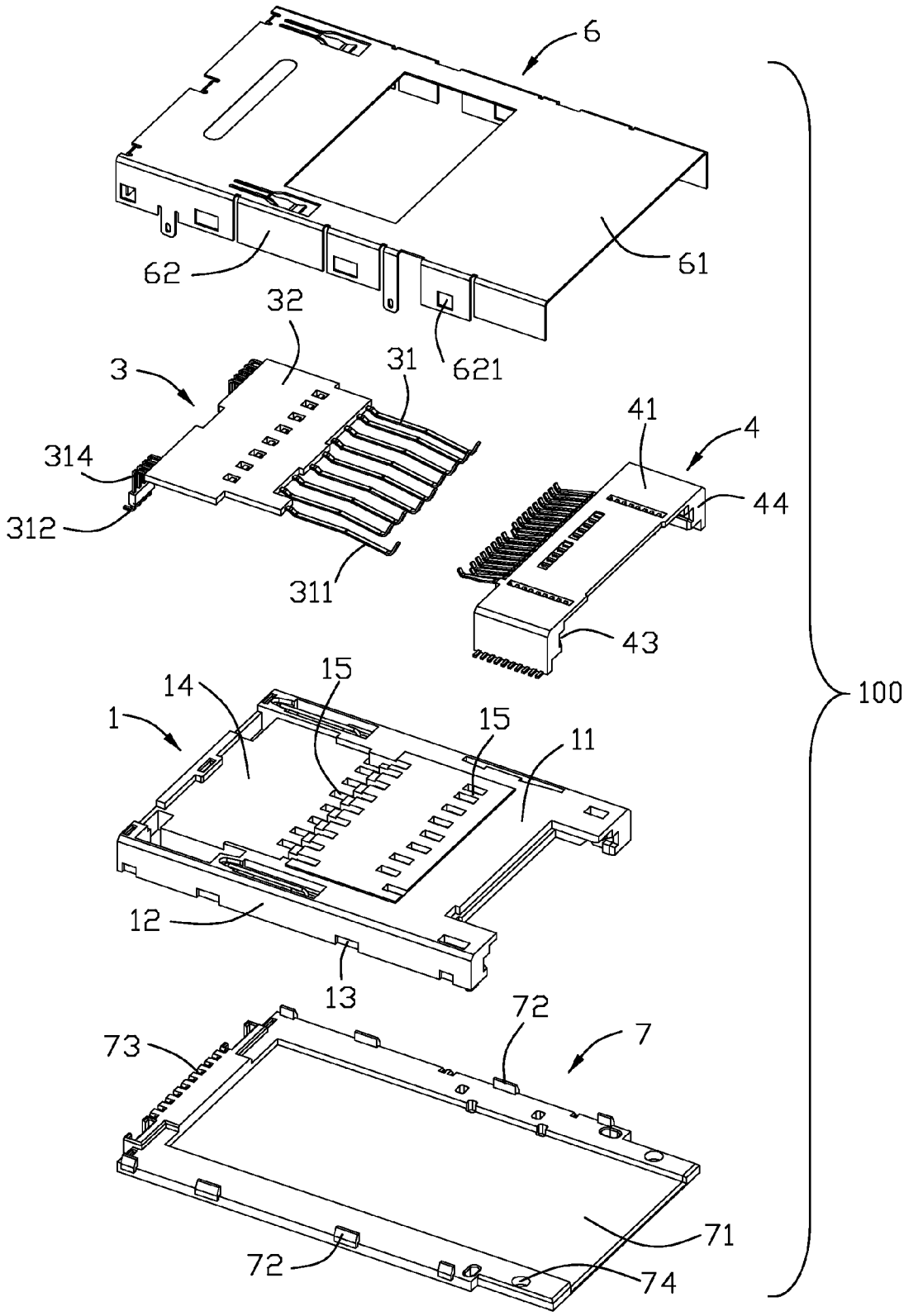
FIG. 3 is an exploded, perspective view of the electrical card connector shown in FIG. 1.
Figure 4:
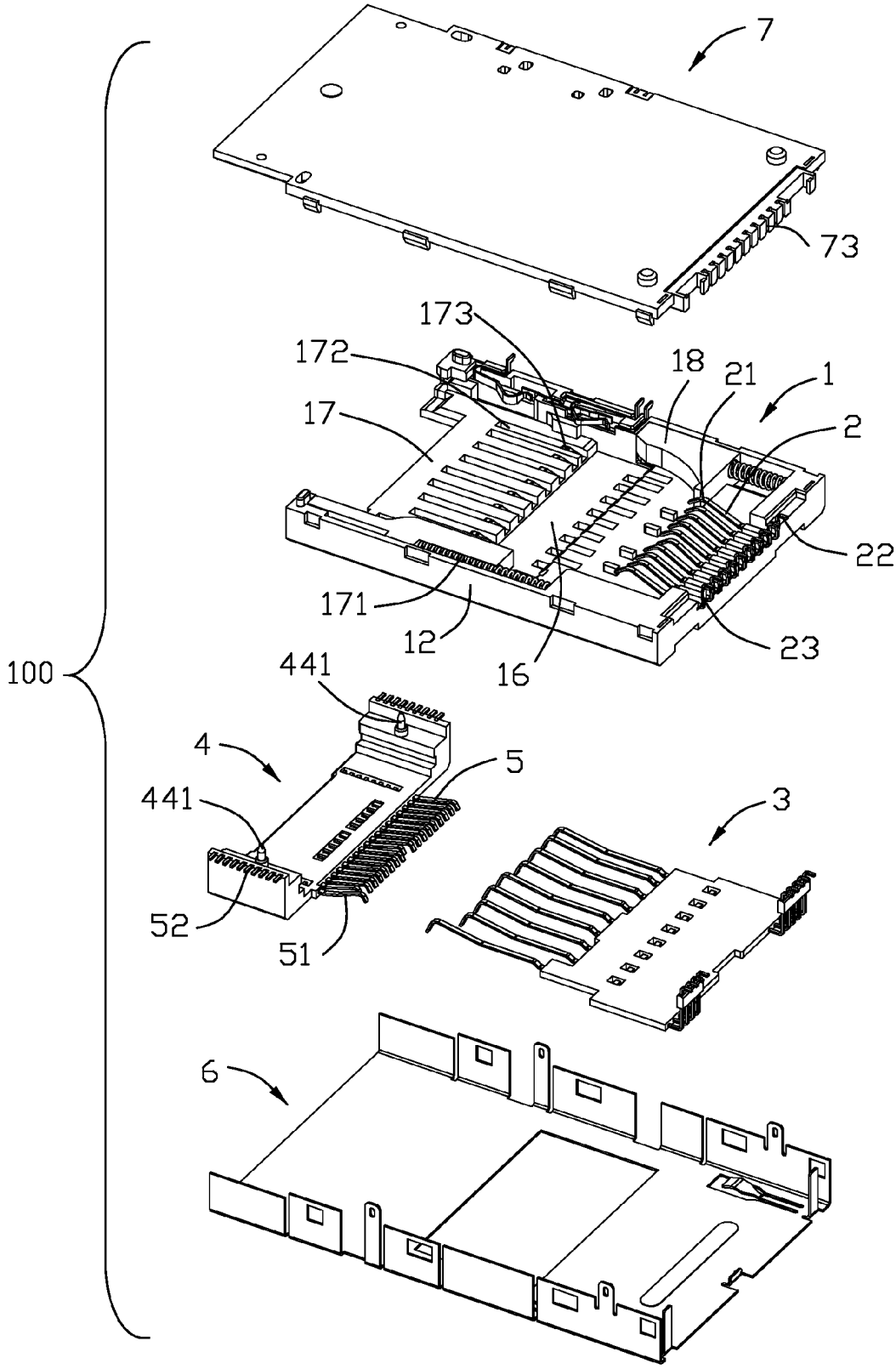
FIG. 4 is an exploded, perspective view of the electrical card connector shown in FIG. 1, but taken from other aspect.
Figure 5:
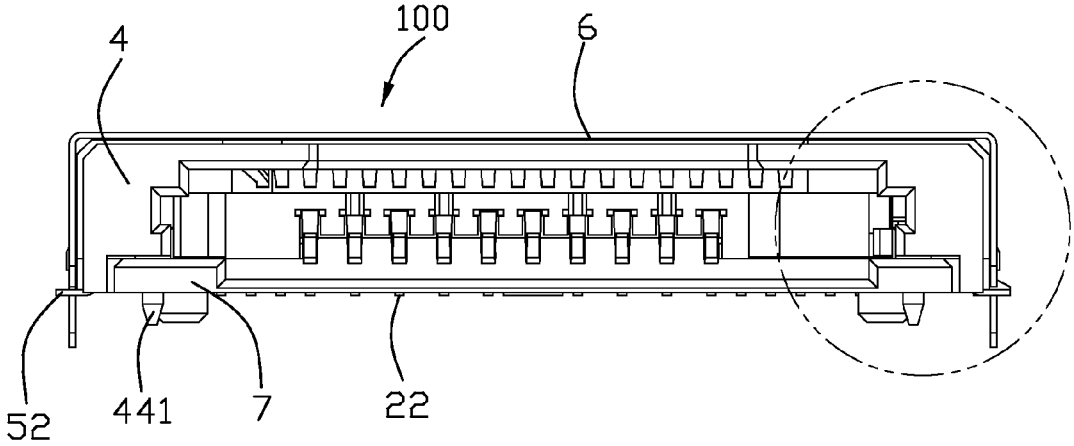
FIG. 5 is a front view of the electrical card connector shown in FIG. 1.
Figure 6:
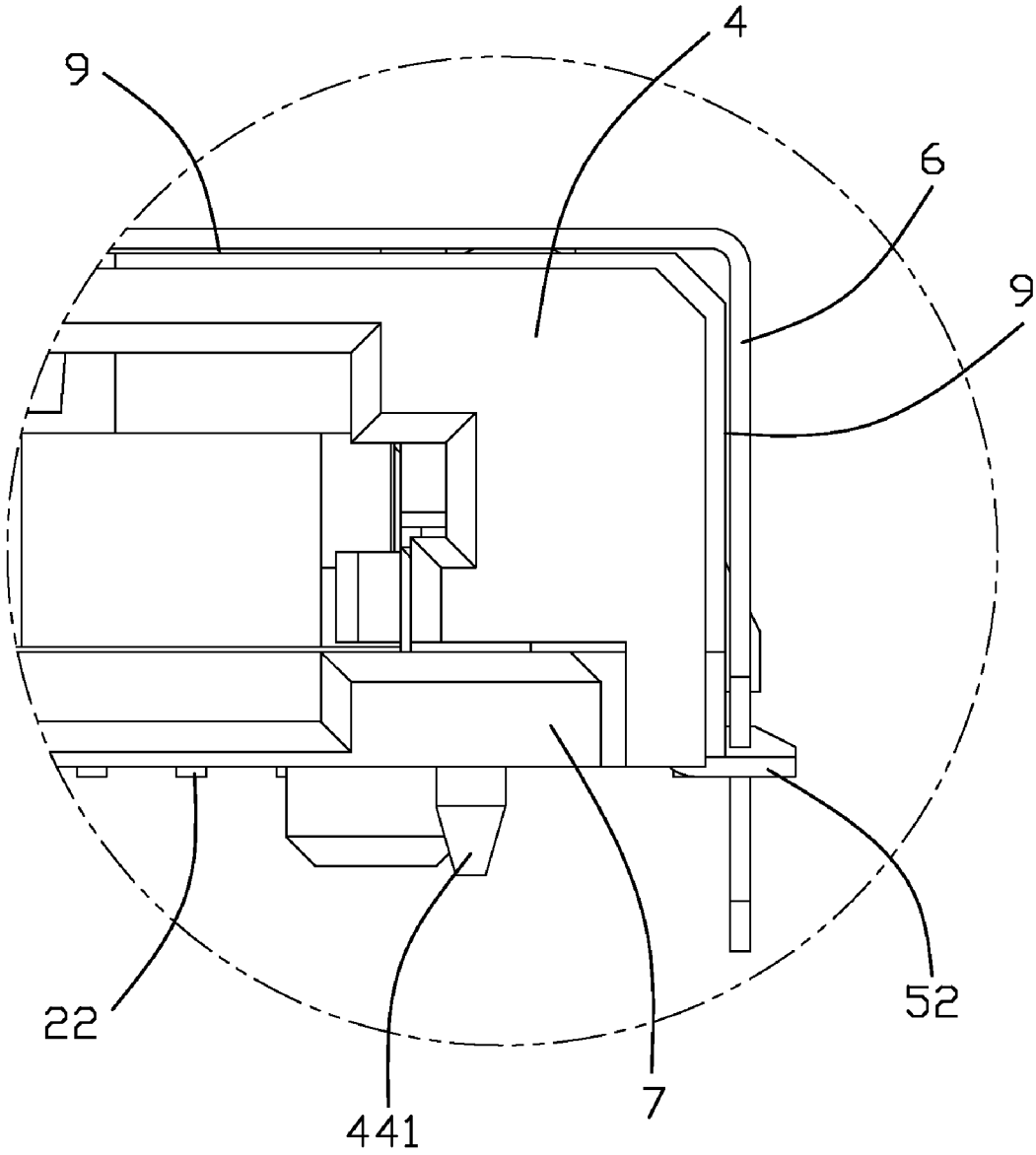
FIG. 6 is an enlarge view of the partial structure of the electrical card connector shown in FIG. 5.

Referring to FIG. 3 and FIG. 4, the first contacts 2 are disposed at the front of the first housing 1, each first contact 2 comprises a first contacting portion 21, a retaining portion (not labeled) for engaging with the first housing 1, a first bending portion 23 extending downwardly and a first soldering portion 22 for soldering on the PCB.

The terminal module 3 is mounted in the receiving portion 14 of the first housing 1, and it comprises an insulator 32 and a plurality of third contacts 31 mounted in the insulator 32. Each third contact 31 comprises a third contacting portion 311, a retaining portion (not labeled) received in the insulator 32, a third bending portion 314 extending downwardly and a third soldering portion 312 for soldering on the PCB. The third contacting portion 311 passes through the though hole 15 and extends into the receiving space 16. Further, the third contacting portion 311 is located in the groove 172 and abuts against the inclined portion 173. When the electrical card is inserted and pushes the slider 17 forwardly, the third contacting portion 311 rose and contacts with the card. When the electrical card is ejected, the third contacting portion 311 moves downwardly to prevent the card crashing into and damaging the third contact 31.

Referring to FIG. 1 to FIG. 6, the shell 6 includes a main portion 61 and a plurality of side portions 62 extending downwardly from the main portion 62, the side portion 62 has a plurality of retaining holes 621.

The bottom plate 7 is located at the bottom of the electrical card connector 100 for loading the first housing 1 and the second housing Page 4 of 10 4. The bottom plate 7 comprises a guiding groove 71 extending in a front- to-rear direction, a plurality of passageways 73 located at the front thereof, a plurality of tubes 72 located at the opposite side thereof and a pair of the mounting holes 74 located at the rear thereof. The guiding groove 71 is used for guiding the narrower electrical card insertion. The passageways 73 are used for receiving the first bending portion 23. The tubes 72 are received in the retaining hole 13 of the first housing 1 partially, and a part of each of the tubes 72 extending outwardly is engaged with the retaining hole 621 of the shell 6.

The second housing 4 is located behind the first housing 1, but separated from the first housing 1. The second housing 4 is disposed in a space (not labeled) defined by the bottom plate 7 and the shell 6. There is a gap 9 between the second housing and the shell 6. The second housing 4 rests onto the bottom plate 7 naturally before being soldered on the PCB, which can moves around the gap 9 to adjust the position itself. The second housing 4 comprises a horizontal portion 41, a fixing portion 44 extending downwardly from the opposite sides of the horizontal portion 41, a guiding post 441 mounted on the fixing portion 44 and a plurality of second guiding grooves 43 formed on the fixing portion 44 for guiding different cards insertion. The guiding post 441 is received in the mounting hole 74, the diameter of the guiding post 441 is smaller than the diameter of the mounting hole 74 to allow the second housing 4 moving in correspondence with the first housing 1. The second guiding groove 43 extends in the front-to-rear direction and communicates with the guiding groove 71 of the bottom plate 7. The second contacts 5 are mounted in the second housing 4, each comprises a second contacting portion 51, a retaining portion (not labeled) received in the second housing 4 and a second soldering portion 52. The second soldering portions 52 extend from the opposite sides of fixing portions 44 and arrange in two lows.

Before the electrical card connector 100 being soldered on the PCB, the second housing 4 with the second contact 5 can move around the gap 9, corresponding to the first housing 1, and then the second soldering portion 52 and the first soldering portion 22 are adjusted to being in coplanar, therefore, all of the second soldering portion 52 and the first soldering portion 22 can be soldered on the PCB without any cold-joints resulted from lack of coplanarity.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical card connector comprising:

a first insulative housing;

a plurality of first contacts mounted in the first insulative housing, each first contact comprising a first soldering portion;

a second insulative housing located behind the first insulative housing;

a plurality of second contacts mounted in the second insulative housing, each second contact comprising a second soldering portion; and a shell covering the first insulative housing and the second insulative housing;

wherein the first housing and the second housing are separated from each other, a gap is formed between the shell and the second housing, the second housing with the second contacts is movable within the shell, and the first soldering portion and the second soldering portion are coplanar.

2. The electrical card connector as claimed in claim 1, further comprising a bottom plate, wherein the first housing and the second housing are assembled on the bottom plate.

3. The electrical card connector as claimed in claim 2, wherein the shell comprises a main portion and a pair of side portions extending from main portion, and wherein the main portion, the side portions and the bottom plate defines a space for receiving the second housing.

4. The electrical card connector as claimed in claim 3, wherein the second housing comprises a guiding post located at a bottom thereof, and the bottom plate forms a mounting hole for receiving the guiding post.

5. The electrical card connector as claimed in claim 4, wherein the diameter of the guiding post is smaller than the diameter of the mounting hole.

6. The electrical card connector as claimed in claim 5, wherein the first housing comprises a pair of side walls, a plurality of retaining holes are formed on said plurality of side walls, side wall, and the bottom plate forms a plurality of tubes mating with retaining holes.

7. The electrical card connector as claimed in claim 1, further comprising a terminal module with a plurality of third contacts, and wherein the terminal module is assembled on a top surface of the first housing.

8. The electrical card connector as claimed in claim 7, further comprising a slider assembled on the first housing, and wherein the slider has a plurality of slots and inclined portions located at the front of the slots, and the third contacts abut against the inclined portions and are received in the slots.

9. The electrical card connector as claimed in claim 1, wherein the first contacts are located at the front of the first housing, and the second contacts are located at the opposite sides of the second housing and arranged in two rows.

10. An electrical comprising:

a first insulative housing;

a plurality of first contacts mounted in the first insulative housing, each first contact comprising a first soldering portion;

a second insulative housing located behind the first insulative housing;

a plurality of second contacts mounted in the second insulative housing, each second contact comprising a second soldering portion; and a bottom plate on which both said first housing and said second housing are mounted and retained under condition that both said first soldering portions and said second soldering portions extend and are exposed outside of said bottom plate while at two opposite sides of the bottom plate;

where in the first housing and the second housing are separated from each other, and at least one of said first housing and said second housing is adjustably movable relative to the bottom plate in a vertical direction to assure both said first soldering portions and said second soldering portions are coplanar.

* * * * *